US006510795B1

(12) United States Patent
Detmers et al.

(10) Patent No.: US 6,510,795 B1
(45) Date of Patent: Jan. 28, 2003

(54) ACCESSORY FOR A PRINTING UNIT

(75) Inventors: Andreas Detmers, Mauer (DE); Arno Jünger, Nussloch (DE); Jürgen Kreutzkämper, Sinsheim-Hoffenheim (DE); Sven Mader, Dielheim (DE); Christian Meier, Schriesheim (DE); Gotthard Schmid, Malsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/283,821

(22) Filed: Mar. 31, 1999

(30) Foreign Application Priority Data

Mar. 31, 1998 (DE) ..... 198 14 661

(51) Int. Cl.[7] ..... B41F 35/00; B41F 35/06; B41F 7/20

(52) U.S. Cl. ..... 101/480; 101/424.1

(58) Field of Search ..... 101/116, 117, 101/118, 132, 136, 141, 152, 153, 174, 212, 213, 216, 224, 225–228, 232, 352.05, 425, 477, 478–480, DIG. 35, DIG. 36, DIG. 38, 401.1, 182, 184, 185, 209, 243, 351.1–351.4, 352.01, 424.1

(56) References Cited

U.S. PATENT DOCUMENTS

| | | | | |
|---|---|---|---|---|
| 3,737,940 A | * | 6/1973 | Moestue et al. | 101/425 |
| 4,051,781 A | * | 10/1977 | Nishikawa | 101/103 |
| 4,449,453 A | | 5/1984 | Staffer et al. | |
| 4,572,069 A | | 2/1986 | Schwarzbeck | |
| 4,723,487 A | * | 2/1988 | Richardson | 101/126 |
| 4,727,807 A | * | 3/1988 | Suzuki et al. | 101/415.1 |
| 5,072,671 A | | 12/1991 | Schneider et al. | |
| 5,224,424 A | * | 7/1993 | Layland | 101/425 |
| 5,333,545 A | | 8/1994 | Ganter et al. | |
| 5,537,926 A | * | 7/1996 | Beisel et al. | 101/477 |
| 5,644,980 A | | 7/1997 | Kusch et al. | |
| 5,794,531 A | * | 8/1998 | Keller | 101/216 |
| 5,893,323 A | * | 4/1999 | Ishii et al. | 101/116 |
| 5,996,490 A | * | 12/1999 | Baureis et al. | 101/216 |

FOREIGN PATENT DOCUMENTS

| | | |
|---|---|---|
| DE | 31 43 089 C2 | 5/1983 |
| DE | 84 34 012.6 | 2/1985 |
| DE | 34 07 681 C2 | 9/1985 |
| DE | 35 25 743 A1 | 1/1987 |
| DE | 39 23 362 C2 | 2/1990 |
| DE | 38 37 898 A1 | 6/1990 |
| DE | 41 18 697 C2 | 12/1992 |
| DE | 42 18 422 C2 | 12/1993 |
| DE | 94 05 223.9 | 7/1994 |
| DE | 44 43 516 C1 | 4/1996 |
| DE | 296 17 261 U1 | 11/1996 |
| EP | 0 741 025 A2 | 11/1996 |
| GB | 2 150 079 A | 6/1985 |

* cited by examiner

*Primary Examiner*—Daniel J. Colilla
(74) *Attorney, Agent, or Firm*—Laurence A. Greenberg; Werner H. Stemer; Gregory L. Mayback

(57) ABSTRACT

A printing-unit accessory engaged with a printing unit of a printing press, in an operating position of the accessory, and removed from the vicinity of the printing unit, in at least one maintenance position of the accessory, includes a pivoting mechanism securing the accessory to the printing press, the pivoting mechanism being disposed in a region of a side wall of the printing unit in a manner that the accessory is movable into a vertical position adjacent the side wall, and at least one linear guide disposed in front of the side wall so that the accessory is displaceable into a horizontal position thereof distal from the printing unit.

12 Claims, 5 Drawing Sheets

9
1
5
25
23
2
2
8
6
7
12
3
13

9
10
2
12
8
1
8
10
2
5
3
11
1
6
11

ACCESSORY FOR A PRINTING UNIT

BACKGROUND OF THE INVENTION

FIELD OF THE INVENTION

The invention relates to a printing-unit accessory that is engaged with a printing unit of a printing press, in an operating position of the accessory, and is removed from the vicinity of the printing unit, in at least one maintenance position of the accessory, the accessory being secured to the printing press by a pivoting mechanism.

Because the installation space of printing units, especially in offset printing presses, is needed for numerous required printing unit components, such as the inking unit and, as a rule, also the dampening unit, it is often not possible for accessories to be permanently installed. There is accordingly a need for accessories which can be brought into position selectively but can be removed for maintenance work or for changing printing plates or inks, so that this necessary work can be performed. at the printing unit.

U.S. Pat. No. 5,630,363 proposes disposing such an accessory on a pivot arm secured to the top of the printing unit, so that the accessory can be pivoted across the printing unit. However, a hindrance thereto is that the space at the top of the printing unit is often unavailable, either because other devices are already located there or space for such devices must be reserved. Furthermore, the device disclosed in this reference impedes accessibility to the inking unit and can collide with printing plate changers. Pivoting an accessory upwardly in this manner requires considerable space above the printing press and could not be used in rooms with low ceilings.

Another proposal has been made heretofore to pivot the accessory towards the side into a vertical position. However, because most accessories have to engage the inside of the printing unit, this proposal can be used for only a few applications. Just like the pivoting path proposed in the aforedescribed U.S. Pat. No. 5,630,363, the pivoting path into the vertical position requires considerable time, which is a problem especially because, for many types of work, such as changing printing plates, it would actually suffice to move the accessory only a short distance away from the printing unit.

SUMMARY OF THE INVENTION

It is accordingly an object of the invention, therefore, to provide an accessory of the type referred to at the introduction hereto, namely an accessory for a printing unit, that within the shortest possible time can be brought into a region of the printing press wherein it does not impede the work to be performed at the printing unit, because the requisite space is available and need not be reserved for other accessories.

With the foregoing and other objects in view, there is provided, in accordance with the invention, a printing-unit accessory engaged with a printing unit of a printing press, in an operating position of the accessory, and removed from the vicinity of the printing unit, in at least one maintenance position of the accessory, comprising a pivoting mechanism securing the accessory to the printing press, the pivoting mechanism being disposed in a region of a side wall of the printing unit in a manner that the accessory is movable into a vertical position adjacent the side wall, and at least one linear guide disposed in front of the side wall so that the accessory is displaceable into a horizontal position distal from the printing unit.

In accordance with another feature of the invention, the accessory, before being pivoted into the vertical position thereof, is displaceable horizontally at least far enough so that it no longer engages in the printing unit.

In accordance with a further feature of the invention, the pivoting mechanism and the linear guide are disposed on a side of the side wall.

In accordance with an added feature of the invention, the accessory includes a centering device for positioning the accessory exactly in the operating position thereof.

In accordance with an additional feature of the invention, the accessory includes a locking device for locking the accessory with a retaining force in a centered position thereof.

In accordance with yet another feature of the invention, the centering device has at least one bolt engageable in a prism.

In accordance with yet a further feature of the invention, the centering device has at least one stop.

In accordance with yet an added feature of the invention, the locking device is at least one pneumatic element for pressing the accessory against contact faces of the centering device.

In accordance with yet an additional feature of the invention, the accessory includes a drive mechanism and a cam with a cam roller embodied for imparting a horizontal displacement to the accessory at an onset of an adjusting motion, and for thereafter providing the pivoting motion for disposing the accessory in the vertical position thereof.

In accordance with a concomitant feature of the invention, the accessory includes a spring for reinforcing the pivoting motion.

By the device according to the invention, it is possible to place the accessory into one of two maintenance positions, as needed. For many operations at the printing unit, and especially for printing plate changing, a horizontal displacement of the accessory suffices. By this horizontal displacement, the accessory is moved away from the cylinders in a direction parallel thereto. If a further printing unit follows in a multicolor printing press, the accessory device is moved into a corridor between printing units. The horizontal displacement requires only an extremely short time, so that the down time of the printing press, for example, for changing printing plates, is not increased in length, and thus there is no loss of press productivity. For major maintenance work, such as cleaning the printing unit, changing the rubber blanket, and so forth, the accessory can be moved into a region wherein it is entirely out of the way for this work, and wherein collision problems with other accessories do not arise, nor is the space taken up thereby and have to be reserved therefor, respectively. No further space above the printing unit is required by the device according to the invention, and thus it is possible to adhere to a machine height of approximately 2.60 m even for large printing presses, so that these machines can be used even in printing plants with a low ceiling height.

Because both horizontal displacement and pivoting of the accessory are possible, no problem is presented if an accessory engages in the printing unit. The embodiment according to the invention offers the opportunity that the accessory, before being pivoted into the vertical position thereof, is displaced horizontally at least so far that it no longer engages in the printing unit.

Expediently, it is proposed that the pivoting mechanism and the linear guide be disposed on the side of the side wall.

Consequently, the control side is kept free, and the pivoted-away accessory presents the least hindrance, nor is it in the way if a worker wants to walk between the printing units.

Particularly if the accessories are imaging devices, such accessories must be positioned extremely precisely so that such an image will match with the press register. It is therefore proposed that the accessory be positioned exactly in the operating position by a centering device. It can also be proposed that a locking device lock the accessory in the centered position with a retaining force. As a result, any relative motion between the imaging device and the plate cylinder, for example, is precluded, and even vibrations cannot cause such a relative motion.

An embodiment of the invention provides for the centering device to have at least one bolt that engages a prism. Because of the horizontal alignment of the prism in the bolt, exact horizontal positioning can be attained, which is especially important for imaging units. For an exact alignment vertically, provision can be made for the centering device to have at least one stop. This stop is expediently spaced apart vertically from the prism. One embodiment of the locking device provides for it to be at least one pneumatic element, which presses the accessory against contact faces of the centering device.

An embodiment of a device for performing the adjusting motions of the accessory device calls for a drive mechanism and a cam with a cam roller to be provided, and embodied in such a manner that they impart the horizontal displacement to the accessory at the onset of the adjusting motion, and thereafter provide the pivoting motion for placing the accessory in the vertical position thereof. Because this construction requires only a drive mechanism, such as a single pneumatic cylinder, hydraulic cylinder or electric drive mechanism, it is especially simple and economical. If, in this construction, only the rectilinear part of the cam is traversed by the cam roller, then the horizontal displacement of the accessory into the horizontal maintenance position occurs. In this position, a printing plate change or similar work can, for example, be performed. For more complicated maintenance work, the cam roller traverses a cam section or length wherein the cam roller is pivoted 90°. In this way, with the same single drive mechanism, the pivoting motion is also performed in order to reach or attain the maintenance position wherein the accessory is disposed vertically in front of a side wall of the printing unit, and the printing unit is made available for major maintenance work.

For both of the embodiments mentioned hereinbefore and for other embodiments, it is expedient if a spring, preferably a gas compression spring, reinforces the pivoting motion. In the foregoing exemplary embodiment, this provides the advantage that no long levers for force transmission are needed between the cam roller and the accessory.

Another construction, wherein the pivoting motion of the accessory device is initiated manually, provides that the spring and force transmission be formed in a manner that the accessory pivots automatically into the vertical position, the instant that it is pivoted a predetermined angle, such as 30°, manually from the horizontal position. If this construction involves accessories which engage in the printing units, it is expedient not to enable the pivoting into the vertical position only if the accessory has been displaced so far horizontally that it not longer engages in the printing unit. In this embodiment, a drive may be provided for the horizontal displacement. This drive can of course also be provided manually, but an automatic drive mechanism, preferably one or two pneumatic cylinders, is much more expedient.

One material application is where the accessory is an imaging device, that is engaged with or thrown onto the plate cylinder in the operating position of the accessory. Such imaging devices may be a laser lighting unit for the plate cylinder or also a device disposed on the rubber blanket cylinder or printing cylinder to make impressions in the printed sheets, for example, in the form of sequential numbers or other individual impressions for the individual imprints. To that end, an ink jet unit or a numbering mechanism can be used, for example. Naturally, it is also possible, however, in this manner to provide other accessory devices for a printing unit, such as an additional inking or varnishing unit, a dryer, or measuring systems in the form of measuring beams, for example, for register or ink measuring.

Other features which are considered as characteristic for the invention are set forth in the appended claims.

Although the invention is illustrated and described herein as embodied in an accessory for a printing unit, it is nevertheless. not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE INVENTION

DESCRIPTION OF THE INVENTION

Figure 1:
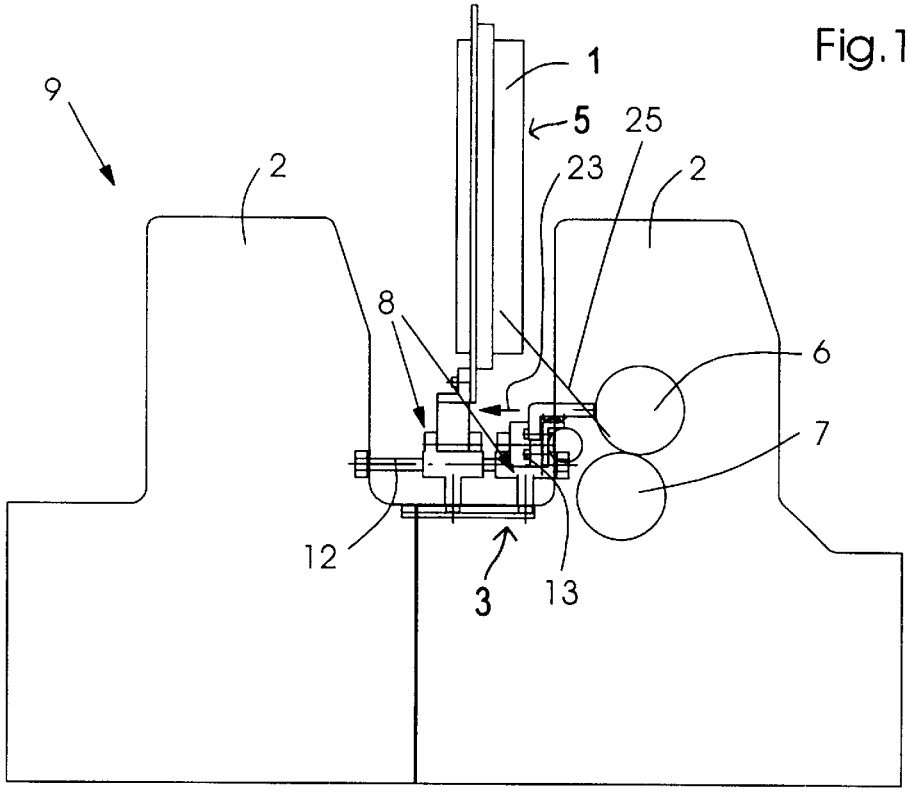
FIG. 1 is a fragmentary diagrammatic side elevational view of a printing press, provided with a first exemplary embodiment of an accessory therefor.
Figure 5:
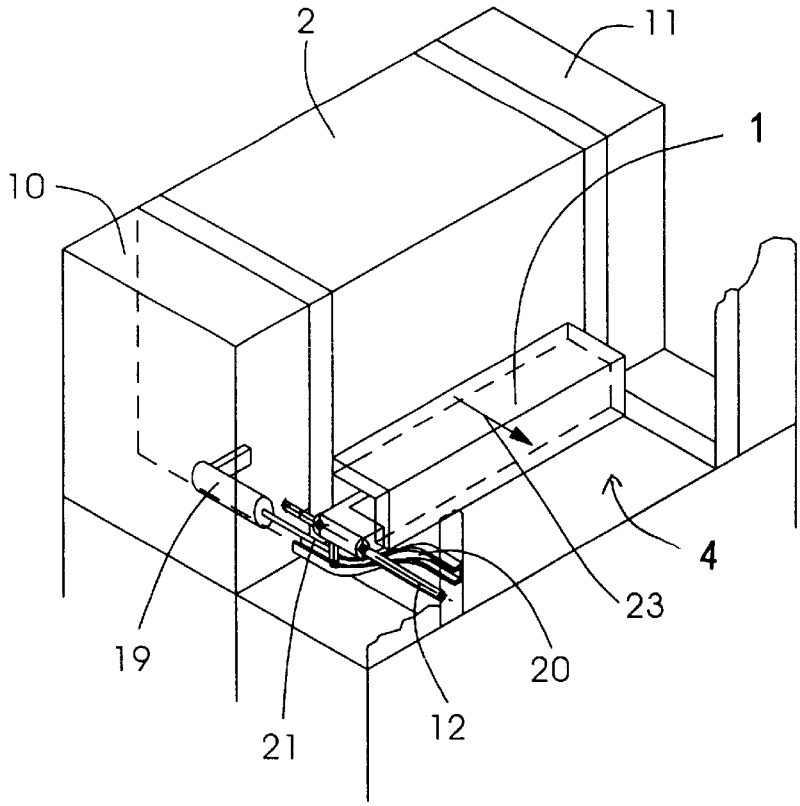
FIG. 5 is another view like that of FIG. 5, showing the second exemplary embodiment of the accessory in a horizontal maintenance position thereof.

Referring now to the drawings and, first, particularly to FIG. 1 thereof, there is shown therein, in a side elevational view, a first exemplary embodiment of the invention. Two printing units 2 of a printing press 9 are shown therein. An accessory 1 is shown both in an operating position 3 thereof and in a vertical maintenance position 5 thereof. Naturally, it assumes one position or the other. Such an accessory 1 may be assigned to a particular printing unit 2 or to any arbitrary printing unit in a printing press 9. In the operating position 3, the accessory 1 can perform work on a cylinder, such as the plate cylinder 6 or rubber blanket cylinder 7. The embodiment shown is an accessory 1, for example, a laser unit that provides an image on a printing plate 25 located on a plate cylinder 6. To change printing plates, it suffices for the accessory 1 to be displaced a short distance horizontally to the rear into a maintenance position 4 (as shown in FIG. 5). From the printing plate 25 shown, it can be seen how much space must be made available for this printing plate change. The maintenance position 5 shown is the vertical position that the accessory 1 must assume if relatively major work is to be performed at the printing unit 2. The horizontal displacement is provided by a linear guide 12, and the pivoting into the vertical position 5 is provided by a pivoting mechanism 8.

Figure 2:
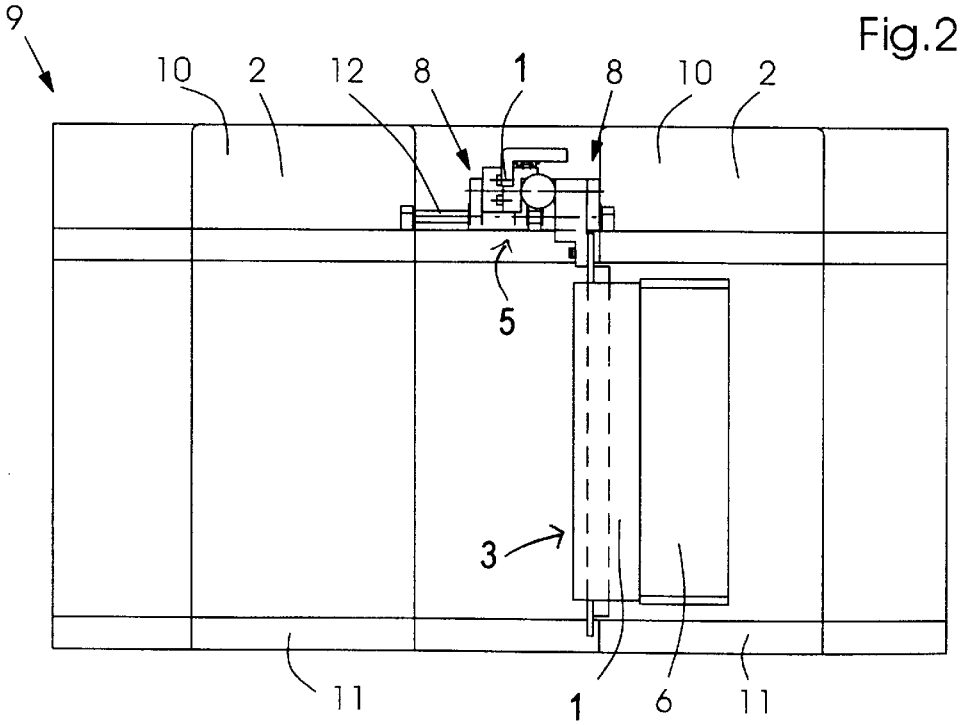
FIG. 2 is a top plan view of FIG. 1.

FIG. 2 shows the same exemplary embodiment as in FIG. 1 in a plan view from which it can be seen how the accessory 1, in the operating position 3 thereof, rests on the printing unit 2, mostly engaging therein, for example, to provide imagings on the printing plate 25 located on the plate cylinder 6.

The plan view illustrates how a side wall 11 of the printing unit 2 is entirely free on the operator or servicing side, and the location of the accessory 1, in the vertical position 5 thereof, next to an opposite side wall 10 of the printing unit 2, i.e., on the drive side of the printing press 9. In the region, the accessory 1 is accordingly not in any obstructive way, because the servicing personnel walk from the control side between the printing units 2 to perform necessary maintnance work.

Figure 3:
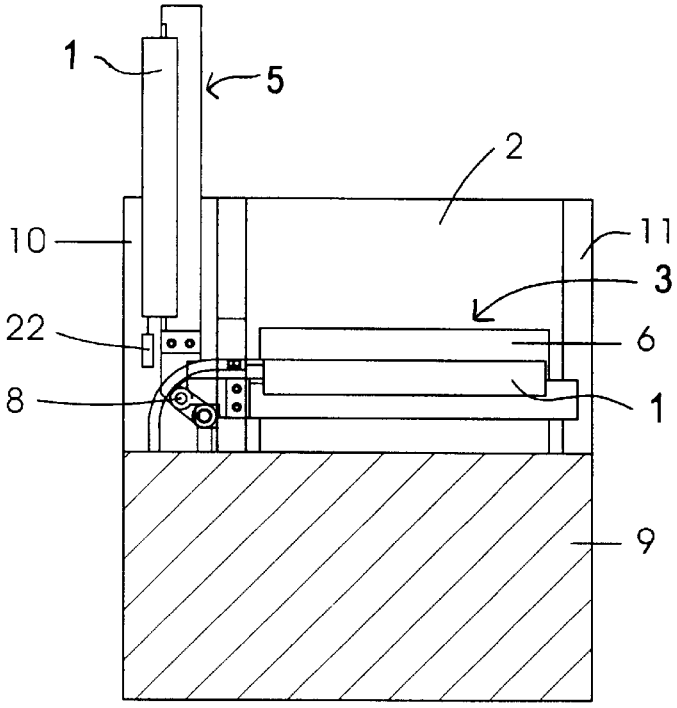
FIG. 3 is a vertical sectional view of FIG. 1 taken along the junction line of the two printing units shown therein.

Finally, FIG. 3 is a vertical sectional view of the printing press 9 of FIG. 2, taken along a line between the printing units 2, and showing the aforedescribed exemplary embodiment of the accessory. Once again, the accessory 1 is shown both in the operating position 3 thereof and the vertical maintenance position 5 thereof. The pivoting from the operating position 3 into the maintenance position 5 is performed by a pivoting mechanism 8. The pivoting can be performed automatically or manually, depending upon the construction of the accessory. To reinforce the pivoting motion, a spring, such as a gas compression spring 22, is preferably provided. It is understood that some other drive mechanism, that performs the adjustment automatically, can also be provided at this location.

Figure 4:
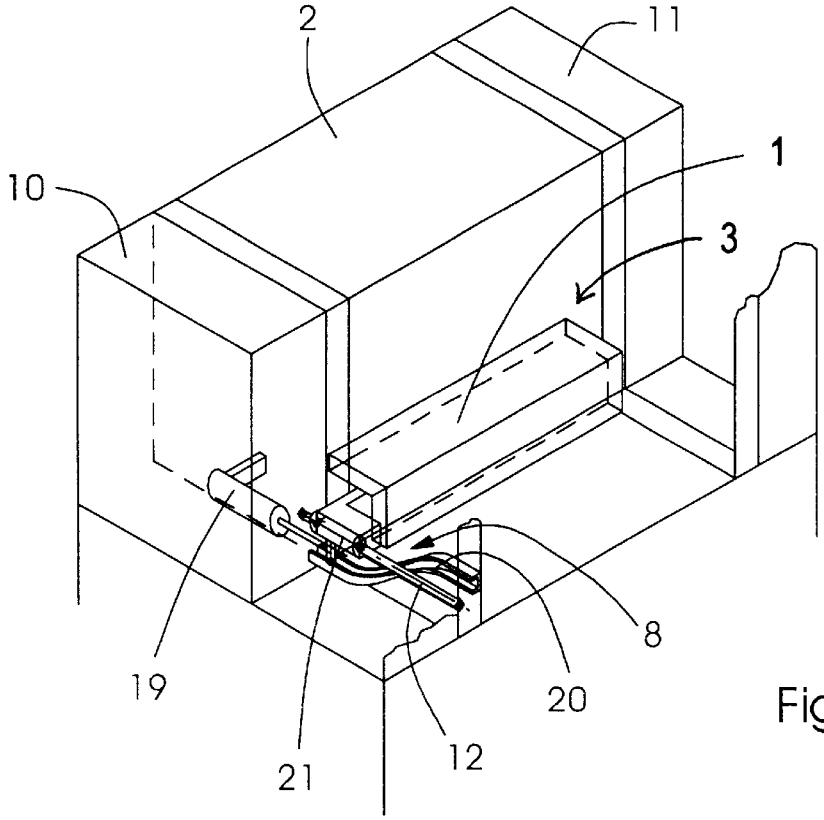
FIG. 4 is a perspective view of a second exemplary embodiment of the accessory in an operating position thereof.

FIG. 4 shows a second exemplary embodiment in a perspective view, with an accessory 1 in the operating position 3 thereof. A linear guide 12 is located on the side wall 10 of the drive side of the printing unit 2 and is embodied so that the accessory 1 is pivotable about the linear guide 12. This guide 12 may be an embraced round bar. A cam 20, in which a cam roller 21 connected to the accessory 1 is movable, is also located on the side wall 10. The cam 20 is formed with a transposition so that there is a 90° change in the orientation of the path of the cam roller 21. In the vicinity of the connection of the cam roller 21 to the accessory 1, a drive mechanism 19 is located, that performs the adjusting motion. This drive mechanism 19 may be pneumatic, hydraulic or electric.

FIG. 5 shows how the drive mechanism 19 displaces the accessory device 1 into the horizontal maintenance position 4 thereof. During this adjusting motion, the cam roller 21 moves in a straight section or length of the cam 20, due to which the accessory 1 remains in the horizontal orientation or disposition thereof.

Figure 6:
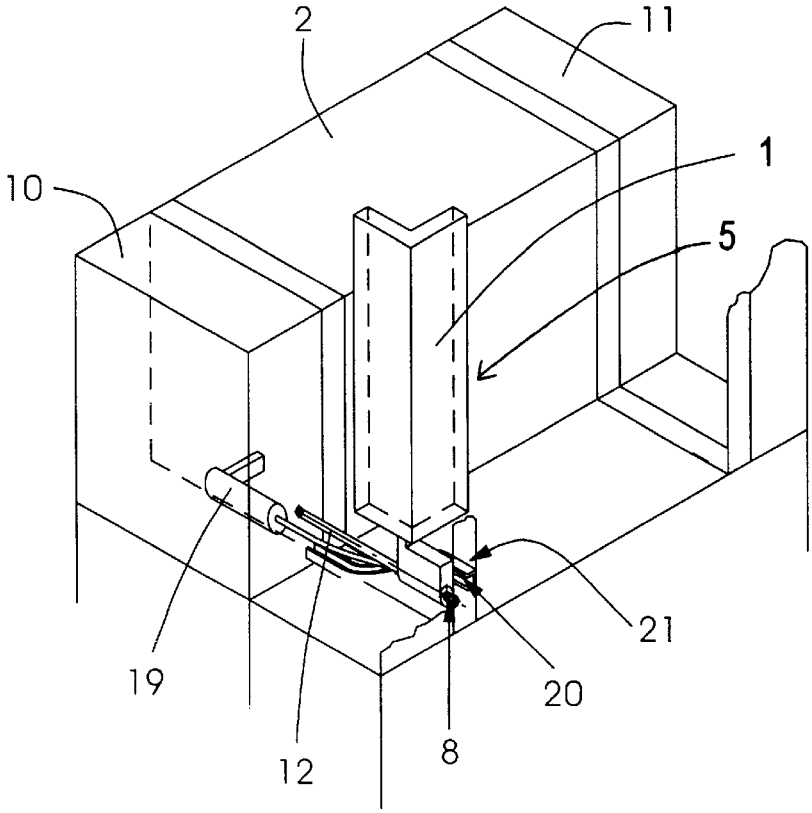
FIG. 6 is yet another view like those of FIGS. 5 and 6, showing the second embodiment of the accessory in a vertical maintenance position thereof.

FIG. 6 shows the pivoting of the accessory 1 into the vertical position 5 thereof. This is attained by having the cam roller 21 traverse the transposition of the cam 20 between the maintenance position 4 and the maintenance position 5 of the accessory 1, the pivoting motion being caused thereby. Expediently, once again in this exemplary embodiment, a spring such as a gas compression spring 22 is provided, however, this has not been illustrated in FIG. 6 in the interest of clarity and simplicity.

Figure 7:
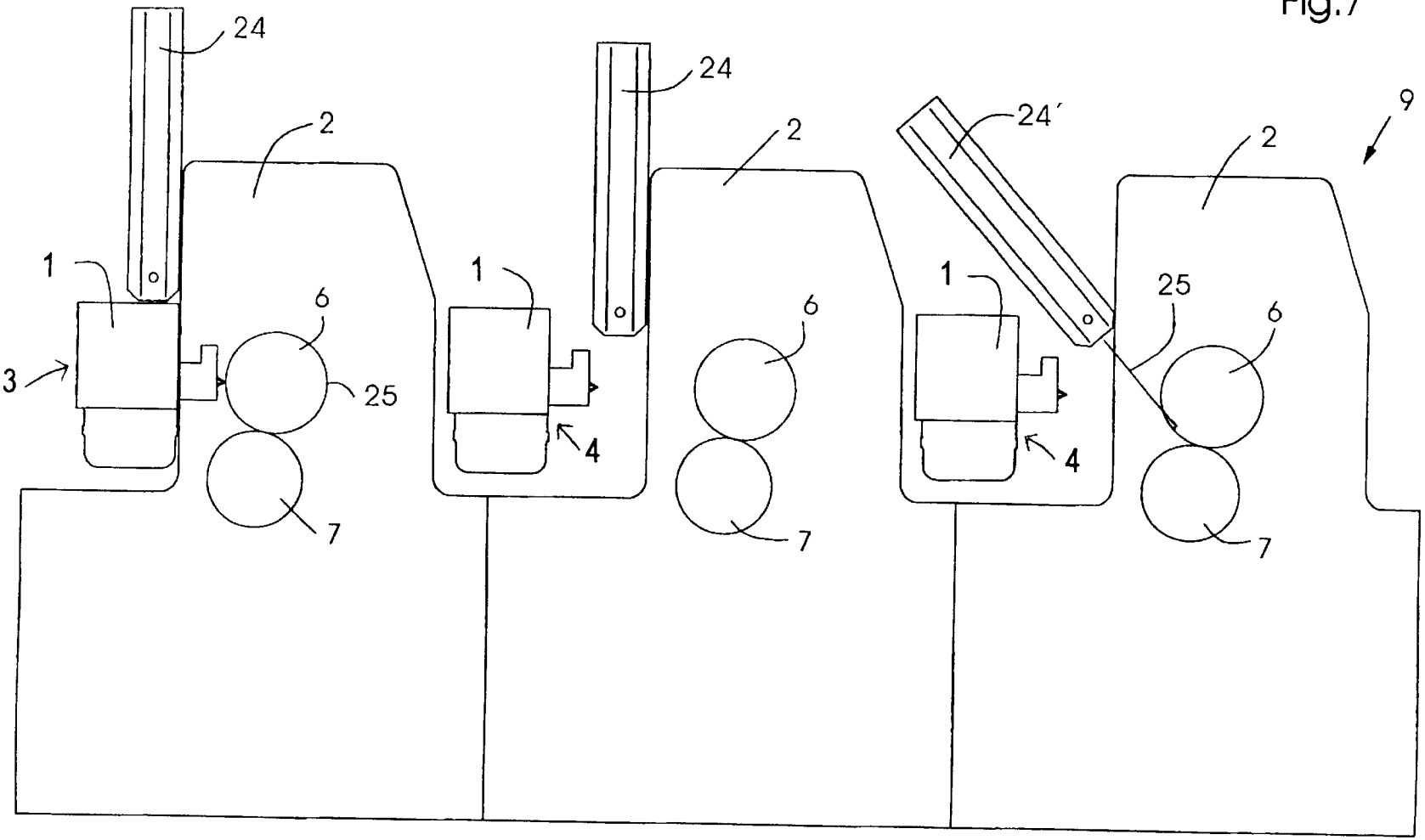
FIG. 7 is a fragmentary diagrammatic side elevational view of a printing press having three printing units with respective accessories according to the invention and respective printing plate changers, disposed in varying maintenance positions.

FIG. 7 shows a printing press 9 with respective accessories 1 and respective printing plate changers 24 and 24', in different operating positions, respectively. The accessory 1 located in the lefthand printing unit 2 is in the operating position 3 thereof, in which it produces imagings, for example, by a laser, on the printing plate 25 that is mounted on the plate cylinder 6. In the middle printing unit 2, the accessory device 1 has been displaced into the horizontal maintenance position 4 thereof, for example, to initiate a printing plate change. In the righthand printing unit 2, the automatic printing plate changer 24' is in the printing-plate changing position thereof, in which it takes a printing plate 25 from the plate cylinder 6 or feeds a printing plate 25 to the plate cylinder 6.

This illustration clarifies how a horizontal displacement of the accessory 1 suffices to enable performing a printing plate change, for example, by an automatic printing plate changer 24 or a semiautomatic printing plate changer. It is believed to be readily understood, however, that there are other types of work for which this displacement into the horizontal maintenance position 4 suffices. Only for major servicing work, such as for a rubber blanket change or for cleaning a printing unit, does the accessory 1 have to be moved into the vertical maintenance position 5.

Figure 8:
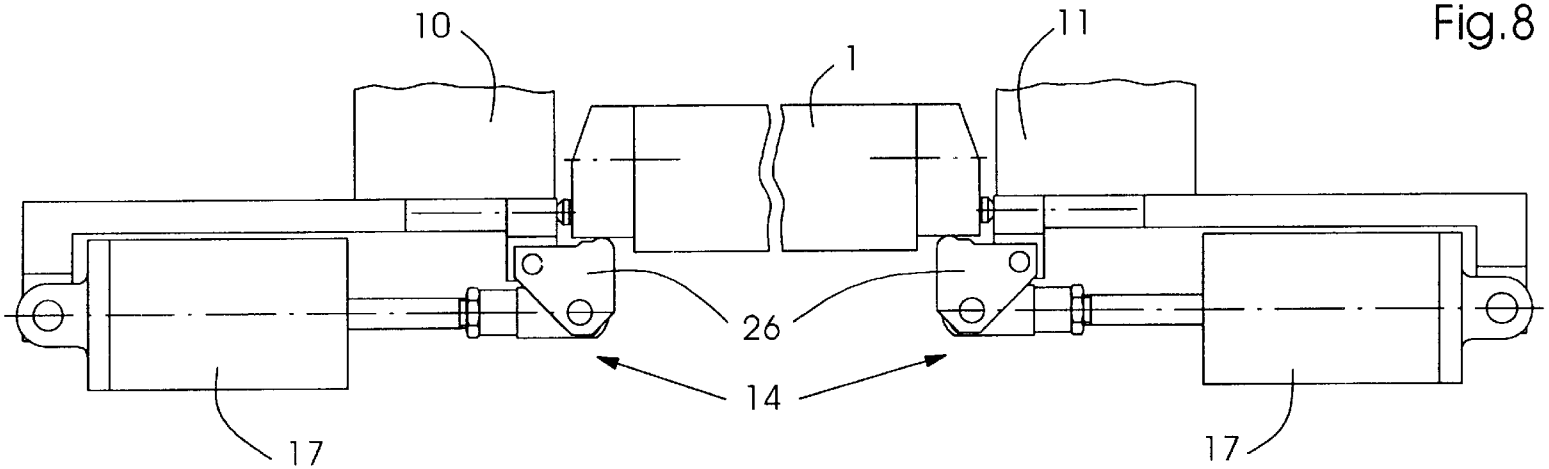
FIG. 8 is an enlarged top plan view of any of FIGS. 4 to 6, showing centering and locking devices of two accessories in greater detail.
Figure 9:
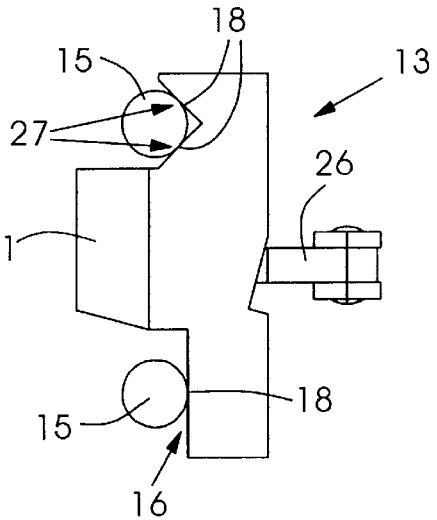
FIG. 9 is a side elevational view of the centering and locking device of one of the accessories in FIG. 8.

FIGS. 8 and 9 show a centering device 13 and a locking device 14 in plan and side views, respectively. Pneumatic elements 17 are disposed on both sides of the accessory 1 on the side walls 10 and 11 and, respectively, act upon locking or tensioning levers 26, and consequently serve as a locking device. The tensioning levers 26 may be pivotably connected to the side walls 10 and 11, and serve to boost the force due to the dimensioning of the levers 26.

More specifically, FIG. 9 shows the function of this locking device 14, by which bolts 15 disposed on the printing press are pressed against contact faces 18 of the centering device 13. The upper bolt 15 is pressed into the contact faces 18 of a prism 27 and, as a result, exact positioning of the accessory 1 is achieved. A stop 16 with a bolt 15 and a straight contact face 18 in the lower region serves to provide the vertical orientation of the accessory 1, as well. In this manner, the accessory 1 is exactly positioned, and an imaging device for the respective imaging is positioned precisely in printing-press register. The horizontal operating positions, for example, of the laser beam, must be attained by a horizontal positioning device therefor. This device is adjusted by at least one sensor relative to the side wall.

The centering device 13 and the locking device 14 discussed hereinabove are only one exemplary embodiment; numerous other locking devices are conceivable, an essential requirement thereof being that the accessory 1 be positioned exactly in height and vertical orientation so as to make it possible for work to be performed in agreement with or matching the printing-press register.

We claim:

1. A printing-unit accessory engaged with a printing unit of a printing press in an operating position of the accessory and removed from the vicinity of the printing unit in at least one maintenance position of the accessory, the printing-unit accessory comprising: at least one linear pivoting guide securing the accessory to the printing press, said at least one linear pivoting guide disposed adjacent a side wall of the printing unit and configured to displace the accessory into a horizontal position away from the printing unit and then to move the accessory into a vertical position adjacent the side wall.

2. The accessory according to claim 1, wherein the accessory, before being pivoted into said vertical position thereof, is displaceable horizontally at least far enough so that it no longer engages in the printing unit.

3. The accessory according to claim 2, including a drive mechanism and a cam with a cam roller embodied for imparting a horizontal displacement to the accessory at an onset of an adjusting motion, and for thereafter providing the pivoting motion for placing the accessory in the vertical position thereof.

4. The accessory according to claim 1, wherein said at least one linear pivoting mechanism is disposed on a side of the side wall.

5. The accessory according to claim 1, including a centering device for positioning the accessory exactly in the operating position thereof.

6. The accessory according to claim 5, including a locking device for locking the accessory with a retaining force in a centered position thereof.

7. The accessory according to claim 5, wherein said centering device has at least one bolt engageable in a prism.

8. The accessory according to claim 5, wherein said centering device has at least one stop.

9. The accessory according to claim 5, wherein said locking device is at least one pneumatic element for pressing the accessory against contact faces of said centering device.

10. The accessory according to claim 1, including a spring for reinforcing the pivoting motion.

11. The accessory according to claim 1, including a drive unit displacing the accessory initially horizontally away from the printing unit to a given separation distance and subsequently continuing displacement of the accessory away from the printing unit while said at least one linear pivoting guide rotates the accessory into a vertical position adjacent the side wall.

12. A printing-unit accessory engaged with a printing unit of a printing press in an operating position of the accessory and removed from the vicinity of the printing unit in at least one maintenance position of the accessory, the printing-unit accessory comprising:

at least one guide securing the accessory to the printing press, said at least one guide disposed adjacent a side wall of the printing unit and configured to displace the accessory into a horizontal position away from the printing unit along a direction parallel to the printing unit, the accessory being selected from the group consisting of an imaging device, an ink-jet unit, an additional varnishing mechanism, a dryer, and a measuring system.

* * * * *